US005522239A

United States Patent [19]

Schwartz et al.

[11] Patent Number: 5,522,239

[45] Date of Patent: Jun. 4, 1996

[54] STACKABLE COOLING INSERT FOR BEVERAGE CONTAINERS

[76] Inventors: James A. Schwartz; Sue A. McDowell, both of 10705 Indian Rocks Rd., Belleaire, Fla. 34616

[21] Appl. No.: 387,451

[22] Filed: Feb. 13, 1995

[51] Int. Cl.[6] ..... F25D 3/08

[52] U.S. Cl. ..... 62/457.5; 62/457.4; 62/530; 62/371

[58] Field of Search ..... 62/371, 372, 400, 62/457.1, 457.2, 457.3, 457.4, 457.5, 457.7, 529, 530, 60

[56] References Cited

U.S. PATENT DOCUMENTS 2,075,137 3/1937 Rosen .
3,840,153 10/1974 Devlin .
4,338,795 7/1982 House, Jr. .
4,383,422 5/1983 Gordon et al. .
4,741,176 5/1988 Johnson et al. .
4,932,225 6/1990 Bighouse .
4,981,022 1/1991 Snyder .
5,129,238 7/1992 Schwartz et al. .

*Primary Examiner*—John M. Sollecito
*Attorney, Agent, or Firm*—Harold D. Shall

[57] ABSTRACT

A cooling insert for use in a beverage container or in a cooler for beverage containers such as cans which has opposed enlarged ends sized to fit in the beverage container with opposed grooves or concave openings formed in said ends for the passage of a straw or grasping with fingers and with the opposed enlarged ends being connected by an elongated center portion of reduced cross section. The ends being dimensioned so that a pair of inserts are stackable.

3 Claims, 3 Drawing Sheets

STACKABLE COOLING INSERT FOR BEVERAGE CONTAINERS

BACKGROUND OF THE INVENTION

1. Field of the Invention

This invention relates to cooling inserts generally and more particularly to cooling inserts which can be placed in a beverage container and also used in a cooler in which beverage container or other items to be cooled are placed.

It is well known in the prior art to place frozen items such as ice or a freezable insert such as shown in U.S. Pat. No. 5,129,238 into a beverage container to cool the contents thereof. However, items such as ice, melt and dilute the beverage in the container, and cooling inserts such as shown in the U.S. Pat. No. 5,129,238 must be secured to the cap or to the container or else move about in the container. Further, the prior art devices for use in a beverage container are not stackable in a cooler to receive beverage containers such as cans, in a manner to secure the cans while cooling the same.

It is, therefore, an object of this invention to provide a cooling insert which may be used in a beverage container in a secure yet removable manner and which may also be used in a cooler for beverage containers such as cans and if properly dimensioned, can be stacked.

SUMMARY OF THE INVENTION

This invention is a cooling insert which is shaped and configured to be received in a standard beverage container having cylindrical side walls and a screw on cap. The shape of the insert is such that the top and bottom thereof have opposed semi-cylindrical shapes with the portions intermediate the cylindrical portions relieved to allow grasping and removal by the fingers of the user and the passage thereby of a straw to withdraw fluid from within the container. The relieved portion intermediate the semi-circular shapes can be formed as concave semi-cylindrical apertures so that when the cooling inserts are stacked, the semi-cylindrically shaped portions can be receivable in the concave semi-cylindrical apertures. The portions intermediate the opposed ends are reduced in cross section from that of the opposed ends so that a beverage container containing the inserts has room for beverages and also when the inserts are stacked in a cooler, beverage containers, such as cans, can be received in the reduced cross sectional areas.

DESCRIPTION OF THE PREFERRED EMBODIMENT

Figure 1:
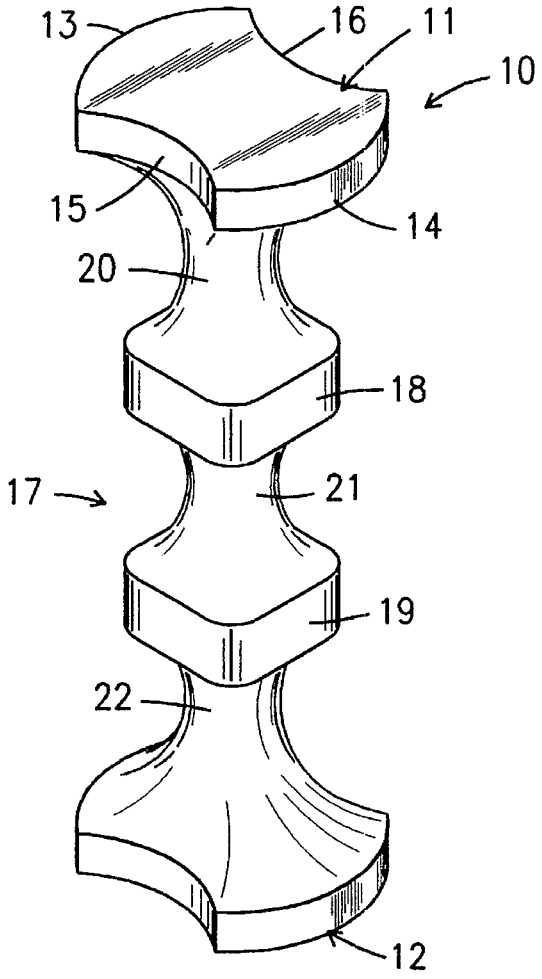
FIG. 1 is a perspective view of a cooling insert of this invention.
Figure 2:
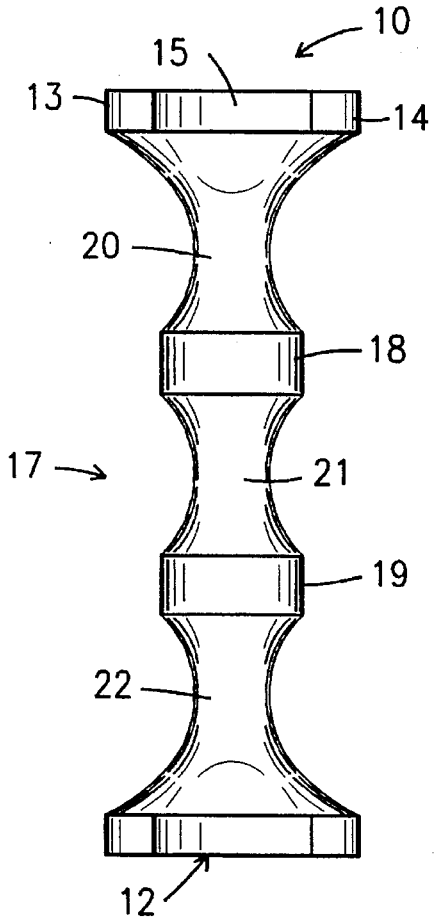
FIG. 2 is a front elevational view of the cooling insert of FIG. 1.

Referring now to the drawings, and more particularly to FIGS. 1, 2, 4, 5, 6 and 7, a cooling insert is shown generally at 10 and includes a pair of opposed ends 11 and 12. The ends 11 and 12 are both shaped the same and only one will be described. The end 11 includes a pair of diametrically opposed semi-cylindrical portions 13 and 14 interconnected by a pair of opposed semi-cylindrical concave portions 15 and 16. The concave portions of the end 11 are axially aligned with the concave portions on the end 12.

Figure 4:
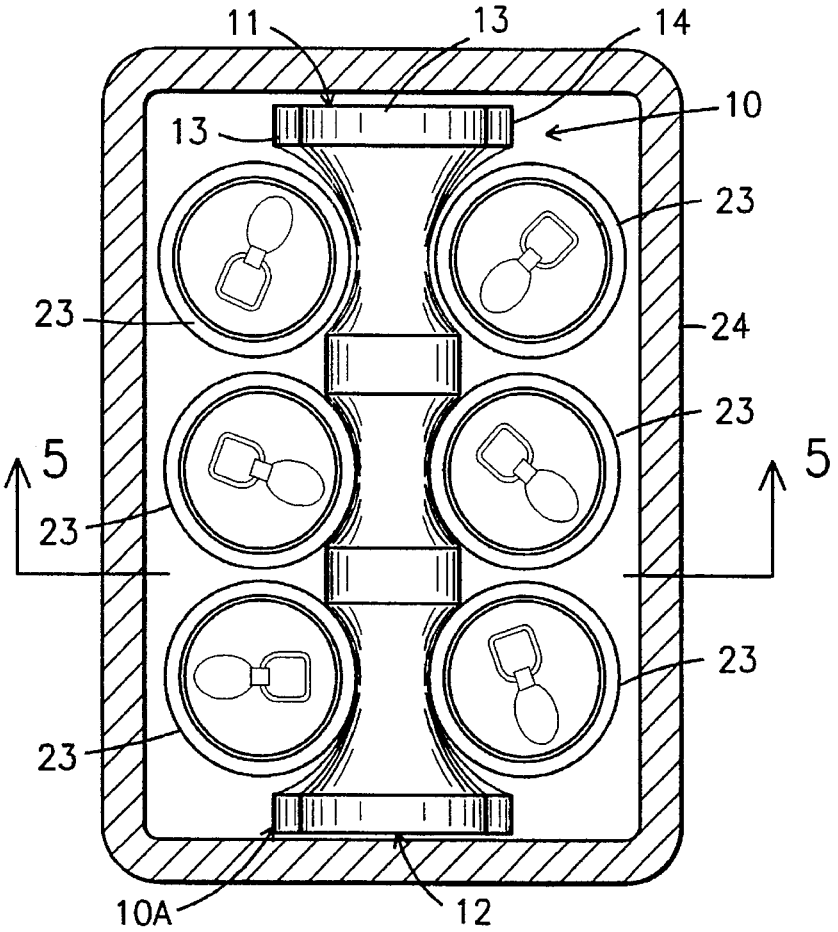
FIG. 4 is a plan view showing the cooling insert of FIG. 1 of this invention in a cooler along with beverage containers being cooled.
Figure 5:
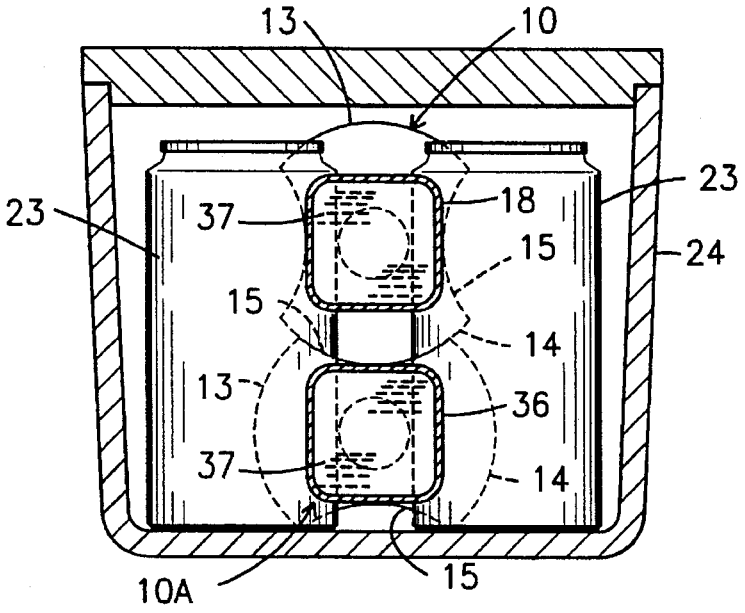
FIG. 5 is a cross sectional view taken along lines 5—5 in FIG. 4 which shows cooling inserts in their stacked relationship.

Interconnecting the opposed ends 11 and 12 is a reduced intermedial portion 17. The portion 17 comprises a pair of spaced knobs 18 and 19, which knobs, when viewed in cross section as seen in FIG. 5, have a cross sectional configuration of a round-cornered square. The knobs 18 and 19 are joined to each other and to the ends 11 and 12 by intermediate portions 20, 21 and 22, which portions 20, 21 and 22 when viewed in cross section (not shown), are arcuately shaped to conform to the exterior cylindrical surface of a beverage containing can 23 (see FIG. 4). As seen in FIGS. 4 and 5, the insert 10 and a like insert 10A, can be stacked and placed in a cooler 24, and when so stacked, can receive a plurality of cans 23. When stacked the semi-cylindrical portions 13 in the ends of the insert 10 are received in the semi-cylindrical concave portions in the ends of the insert 10A, while the knobs 18 and 19 of the inserts 10 and 10A are aligned as are the intermediate portions 20, 21 and 22 of the insert 10 aligned with like portions of the insert 10A.

Figure 6:
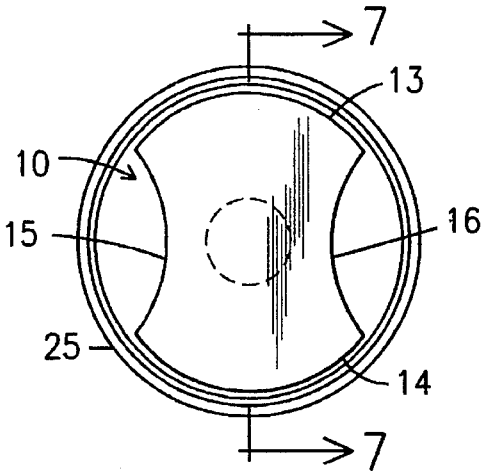
FIG. 6 is a top view of a cooling insert in a bottle with the cap removed for clarity.
Figure 7:
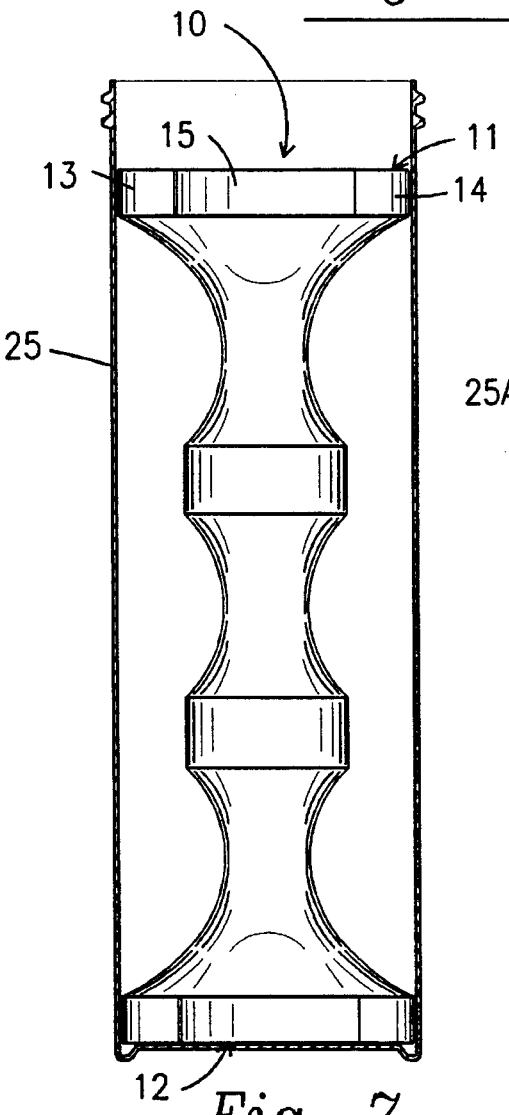
FIG. 7 is a longitudinal sectional view taken along the line 7—7 in FIG. 6, with the cooling insert of FIG. 1 shown in full lines.

As seen in FIGS. 6 and 7, when the insert 10 is placed in a beverage container 25, the semi-cylindrical portions 13 and 14 of the ends 11 and 12 keep the insert in place while the semi-cylindrical concave portions 15 and 16 provide two features. Firstly, they provide an access for fingers to grasp and withdraw the insert from the beverage container, secondly, they provide a path for inserting of a straw into the container for withdrawing a cooled beverage therefrom. It should be noted that the diameters or transverse extent at locations of the portions 13 and 14 are just slightly less than the diameter transverse extent of the beverage container received the same.

Figure 3:
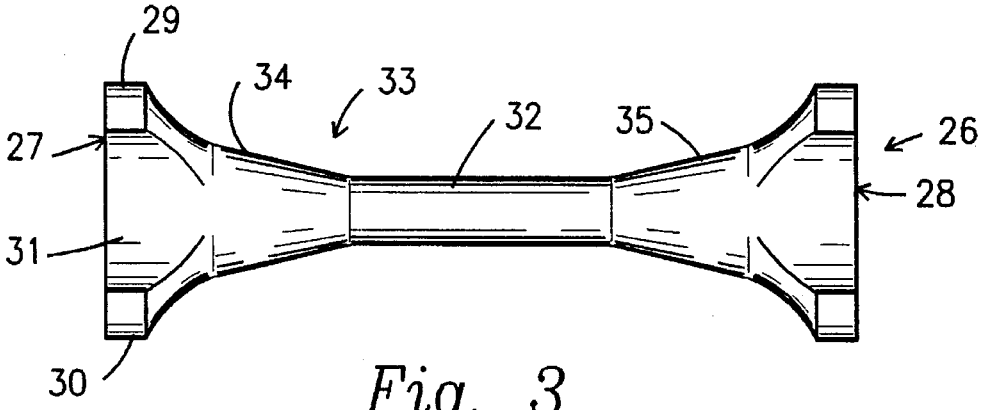
FIG. 3 is a side elevational view of another embodiment of a cooling insert according to this invention.
Figure 8:
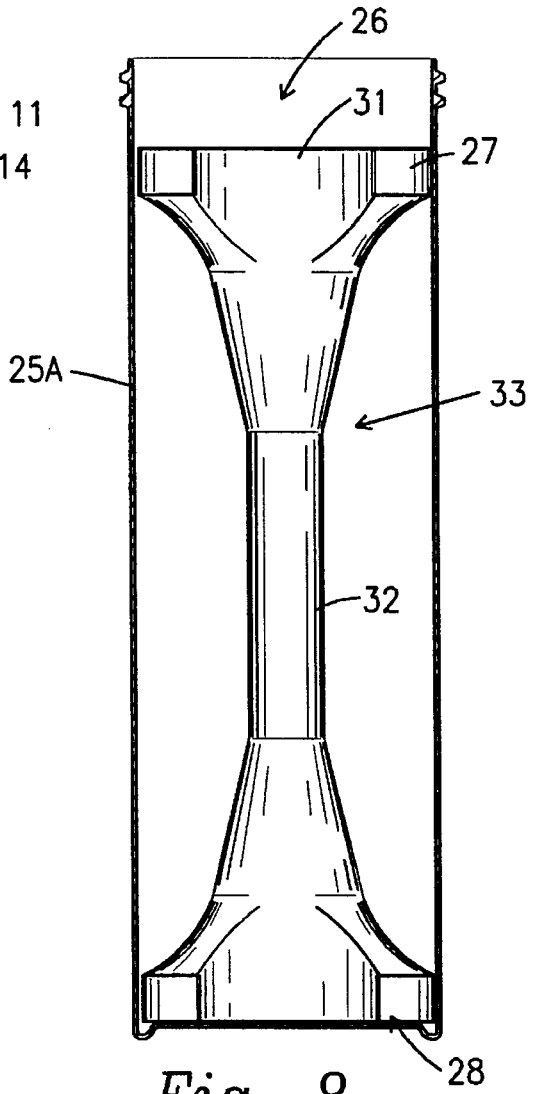
FIG. 8 is a view like FIG. 7 of the embodiment of FIG. 3.

Referring now to FIGS. 3 and 8, a second embodiment of this invention is shown by an insert 26. The opposed ends 27 and 28 of the insert 26 are formed with opposed semi-cylindrical portions 29 and 30 joined by a pair of opposed semi-cylindrical concave portions, one of which is shown at 31. The center portion 32 of the member 33 which connects the ends 27 and 28 is cylindrical while the opposed ends 34 and 35 of the member 33 each are shaped like a truncated cone. The diameter of the center portion 32 and the size of the cones 34 and 35 are such that when a pair of inserts 26 are stacked in a manner similar to that shown in FIGS. 4 and 5, a plurality of cans 23 can be cooled thereby.

As shown in FIG. 8, the insert 33 can be placed in a beverage container 25A and provide the same features of removability and access as the insert 10 does in the container 25.

The inserts 10 and 26 are freezable and have resilient flexible walls as shown at 36 in FIG. 5, with the walls forming a hollow sealed member which is filled with a non-toxic freezable gel as shown at 37 in FIG. 5. The resilient flexible walls provide for expansion of the freezable gel and, additionally, as well known in the art, a small space is allowed at room temperature between the gel and the walls of the inserts to allow for expansion when the gel freezes. Types of aqueous gels or aqueous solutions that can be used with this invention are phenols such as ethylene glycol and propylene glycol, or an aqueous solution of urea having a freezing point between 17° and 25° F. with a small amount of crystal slip agent such as propylene glycol. Equivalent freezable gels can be substituted for the gels set forth herein.

Although the above description relates to presently preferred embodiments, numerous changes can be made therein without departing from the scope of this invention as claimed in the following claims.

What is claimed is:

1. A cooling insert for use in a beverage container and for use in a cooler to cool beverages, said insert comprising (a) an elongated sealed hollow resilient plastic member, and (b) a freezable non-toxic gel substantially filling said plastic member, (c) said insert having opposed enlarged ends and an intermediate portion interconnecting said enlarged ends and having a diameter smaller than said ends, (d) each of said ends having diametrically opposed cylindrical portions interconnected by at least one cylindrical concave portion, with the concave portions of said ends being axially aligned with each other and each being dimensional so as to be capable of receiving one of said cylindrical portions.

2. A cooling insert according to claim 1 wherein each of said ends has a first and a second cylindrical concave portion with said concave portions being diametrically opposed to each other.

3. A cooling insert according to claim 1 wherein said intermediate section has a pair of slight enlargements spaced along the length thereof.

* * * * *